United States Patent [19]

Martinez

[11] Patent Number: 4,669,975

[45] Date of Patent: Jun. 2, 1987

[54] LIQUEFIED GAS IGNITER

[75] Inventor: Carlos M. Martinez, Barcelona, Spain

[73] Assignee: Breval S.A., Switzerland

[21] Appl. No.: 874,556

[22] Filed: Jun. 16, 1986

[30] Foreign Application Priority Data

Apr. 23, 1986 [CH] Switzerland ..... 01657/86

[51] Int. Cl.[4] ..... F23D 13/04

[52] U.S. Cl. ..... 431/344

[58] Field of Search ..... 431/129, 130, 131, 142, 431/143, 150, 254, 344; 251/120, 121, 188; 222/3; 138/37, 40, 42–45

[56] References Cited

U.S. PATENT DOCUMENTS 4,060,202 11/1977 Neyret ..... 431/344 X 4,101,262 7/1978 Neyret ..... 431/344

4,496,309 1/1985 Schächter ..... 431/344

4,560,345 12/1985 Schächter ..... 431/344

*Primary Examiner*—Margaret A. Focarino

*Attorney, Agent, or Firm*—Scully, Scott, Murphy & Presser

[57] ABSTRACT

Liquefied gas igniter having a closure device and a non-regulable limiter for the outwardly directed gas flow. This limiter device comprises a microporous membrane held captive both in its peripheral zone and in its central zone by a first retaining means and a second retaining means; the first retaining means has at least one passage communicating with the reservoir of the igniter, each passage on the membrane side facing a portion of the membrane which is in contact with the second retaining means.

11 Claims, 14 Drawing Figures

LIQUEFIED GAS IGNITER

BACKGROUND OF THE INVENTION

The invention relates to a liquefied gas igniter provided with a reservoir and an outlet chimney, between which a flow of gas can be established; a support member for said outlet chimney; a device for obturating the gas flow passage; a non-regulable gas flow limiter comprising a microporous membrane having a peripheral zone, a central zone and an intermediate zone between said peripheral and central zones, said membrane not permitting the flow of gas in the radial direction in its interior; and a first and a second retaining means between which said peripheral zone of the membrane is held captive and hermetically fastened.

As indicated in the preceding paragraph, the invention relates to igniters which contain a microporous membrane for limiting the gas flow. These microporous membranes are distinguished from porous foams or superposed sheets of fibrous material in that they have much poorer porosity, this being the consequence of an extremely small pore size (equivalent diameter less than $10^{-1}$ microns) and low pore density and the fact that, since their support consists of a firm plastics material and since their pore size is definitively determined by the manufacturing process, they do not permit a variation of the flow through compression or other similar mechanical action, while in addition the circulation of fuel is substantially axial and due more to capillary action than to passage through them, while finally, although the thickness of microporous membranes does not exceed a few hundredths of a millimeter, porous foams and sheets of fibrous material have thicknesses of the order of 1 millimeter or more, which is precisely what enables them to be regulated.

DESCRIPTION OF THE PRIOR ART

It is already known that liquefied gas igniters are provided with a device limiting the gas flow in order to keep the height of the flame at a value lower than the maximum height for normal use. Thus, French Pat. No. 1.051.665 discloses a disc of fibrous material or a diaphragm composed of a washer of porous material held by its edges and situated in the path of the fuel as it flows from the reservoir to the outside.

On the other hand, French Pat. No. 2.313.638 discloses the interposition of a fibrous disc between a microporous membrane and the mouth of the fuel communication passage leading to the outside. This fibrous disc permits radial circulation of the fuel, this circulation being centripetal in view of the fact that said mouth of the passage is situated centrally with respect to the disc.

In this position the fibrous layer permits the passage of the gas downstream of the microporous membrane and in the radial direction from the periphery to the centre, since otherwise the pressure originating from the igniter reservoir would give rise to the partial or complete flattening of the microporous membrane against the support wall, thus making it difficult for the gas to pass in the radial direction and subjecting the microporous membrane to vibration, with consequential variability of the height of the igniter flame.

In Application PCT/AT82/0004, published 30th Sept. 1982 under the international publication number WO 82/0326, a device is disclosed which contains a microporous membrane whose downstream face is adapted to come into contact with a transverse surface at whose centre is situated the mouth of the passage communicating with the outside. This transverse surface is provided with a plurality of radial grooves leading into said mouth, and the fuel circulates on the one hand directly through the membrane to the downstream aperture, and on the other hand firstly through the membrane and then in the centripetal direction through said grooves when the membrane comes into contact with said transverse surface. This form of construction constitutes a complex solution.

In the forms of construction mentioned the part of the membrane facing the aperture in communication with the reservoir is frequently unable to withstand the impact of the mass of liquefied gas (hammering), for example in the event of the igniter being dropped. The use of the igniter after it has been dropped may give rise to an uncontrollable escape of liquefied gas, and therefore to a flame of excessive, dangerous height. In addition, in all these constructions, if the space between hermetic fastening points of the membrane is large (of the order of four times what is proposed in the present invention), the quality of workmanship in the construction of the devices intended to permit the radial flow of the fuel (from the point of passage through the membrane to the outlet aperture to the burner) in the downstream support element will be of great importance.

SUMMARY OF THE INVENTION

The invention seeks to provide an igniter in which the disadvantages mentioned do not occur and in which at the same time the advantages of the arrangements described are retained.

To this end, an igniter of the abovedescribed type has been conceived, which is characterized in that the aforesaid first and second retaining means hold captive and also hermetically fasten said central zone of the membrane, and in that said first retaining means has at least one passage communicating between the reservoir and the membrane, each passage being narrow and having, on the membrane side, a mouth facing a portion of the peripheral or central zone of the membrane which is in contact with said second retaining means.

With the characteristics indicated the possibility of vibration of the membrane is eliminated because of the double fastening (peripheral and central) of the membrane and because of the clear passage of gas through it. In addition, both the narrowness of this passage and the fact that it faces a perfectly supported portion of the membrane make it impossible for the membrane to break through impact with the mass of liquefied gas in the event of any abrupt movement of the igniter. In the course of the description of a preferred embodiment, given with reference to the drawings, mention will be made again of the advantages of the invention in connection with the resistance of the invention to hammering.

In a development of the invention said first retaining means is a male element of substantially cylindrical shape, with a base facing the membrane and having a central projection and a peripheral projection which between them form a first annular passage of slight depth which in turn, in conjunction with the membrane, delimits a first communication chamber, while said second retaining means is a female element which has a cavity and a face forming the bottom of the cavity, the latter being adapted to receive said male element with a good fit, while said face has a central projection and a peripheral projection which between them define a second annular passage which, together with the membrane, delimits a second communication chamber substantially symmetrical to said first chamber, a passage for communication with the outlet chimney starting in said second chamber.

Alternatively, according to the invention said peripheral projection is interrupted by a communication path between said first chamber and said communication passage, which is delimited by a peripheral groove in said male element and by said female element; or said central projection has a groove which brings said first chamber into communication with said communication passage, which is constituted by a substantially central axial aperture.

According to another configuration of the invention said first retaining means is a body of substantially cylindrical shape, with a base facing the membrane and having a central projection and a peripheral projection which define between them a first annular channel of slight depth, which in turn delimits in conjunction with the membrane a first communication chamber, said central projection having a groove which brings said first chamber into communication with said communication passage, which is constituted by a substantially central axial aperture, while said second retaining means is a cap which has an end part facing said base of said body holding the membrane captive, a cylindrical lateral part and means for fastening said body, said cap receiving said body in its interior with a good fit and said end part having internally a second annular passage which together with the membrane delimits a second communication chamber in which starts a communication duct leading to the outlet chimney.

Provision is made for said cap containing said body and said membrane to be fixed in the aforesaid support member for the outlet chimney, and for the end part of said cap to be on the chimney side.

With regard to the closure device, according to a further development of the invention the aforesaid female element is in one piece with said support member which is provided, opposite said cavity in the female element, with a socket for said outlet chimney, which is displaceable longitudinally in the interior of said socket between a first position of maximum penetration and a second position separated by a limited distance from said first position, and which is provided with an internal axial duct, said socket having side walls and an end wall which is in communication with the end wall of the cavity by means of an eccentric aperture, while between the end wall of the socket and the outlet chimney a seal is disposed which has outer edges and inner edges, the latter defining a central aperture substantially in line with said internal axial duct; said seal is adapted to vary its configuration between a first application configuration corresponding to said first position of the outlet chimney, in which position the seal is applied against the end wall of the socket and closes said eccentric aperture, and a second arched position which corresponds to said second position of the chimney and in which the seal does not close said eccentric aperture and by its outer edges is applied to form a tight closure against the end wall and the side walls of the socket, while by its inner edges it is applied to form a tight closure in the proximity of the internal axial duct of the outlet chimney.

In an alternative according to the invention said support member is provided with a socket for the outlet chimney, which is displaceable longitudinally in the interior of said socket between a first position of maximum penetration and a second position separated by a limited distance from said first position, and which is provided with an internal axial duct, said socket having side walls and an internal annular projection, while between the end portion of said cap and the outlet chimney a seal is disposed which has outer edges and inner edges, the latter defining a central aperture substantially in line with said internal axial duct; the seal is adapted to vary its configuration between a first application configuration corresponding to said first position of the outlet chimney, in which position the seal is applied against the end portion of the cap to close said eccentric aperture, and a second arched configuration which corresponds to said second position of the chimney and in which the seal does not close said eccentric aperture, while by its outer edges it is applied to form a tight closure against the inner projection and the walls of the socket and, by its inner edges, is applied to form a tight closure in the proximity of the internal axial duct of the outlet chimney.

BRIEF DESCRIPTION OF THE DRAWINGS

In order to facilitate the understanding of all the foregoing, reference will be made below to the sheets of drawings which accompany this memorandum and which, since they are intended for explanatory purposes, must be considered as not having a limitative character in respect of the scope of the legal protection claimed.

In the drawings.

DESCRIPTION OF THE PREFERRED EMBODIMENTS

Figure 1:
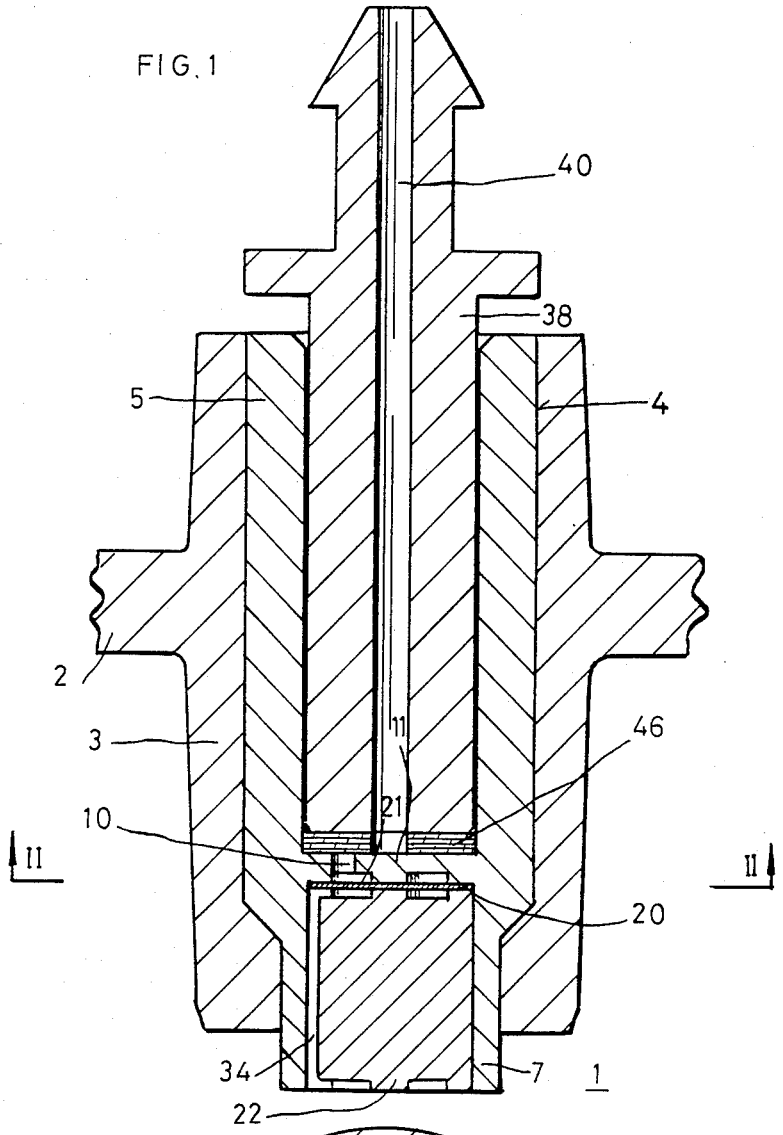
FIG. 1 is an axial section of the valve of a gas igniter, corresponding to the closed position of the valve.
Figure 2:
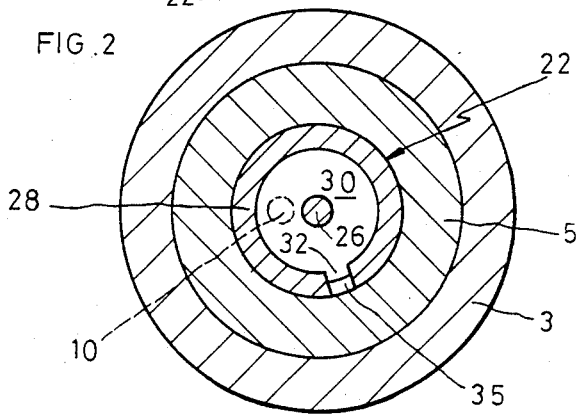
FIG. 2 is a section on the line II—II in FIG. 1.
Figure 3:
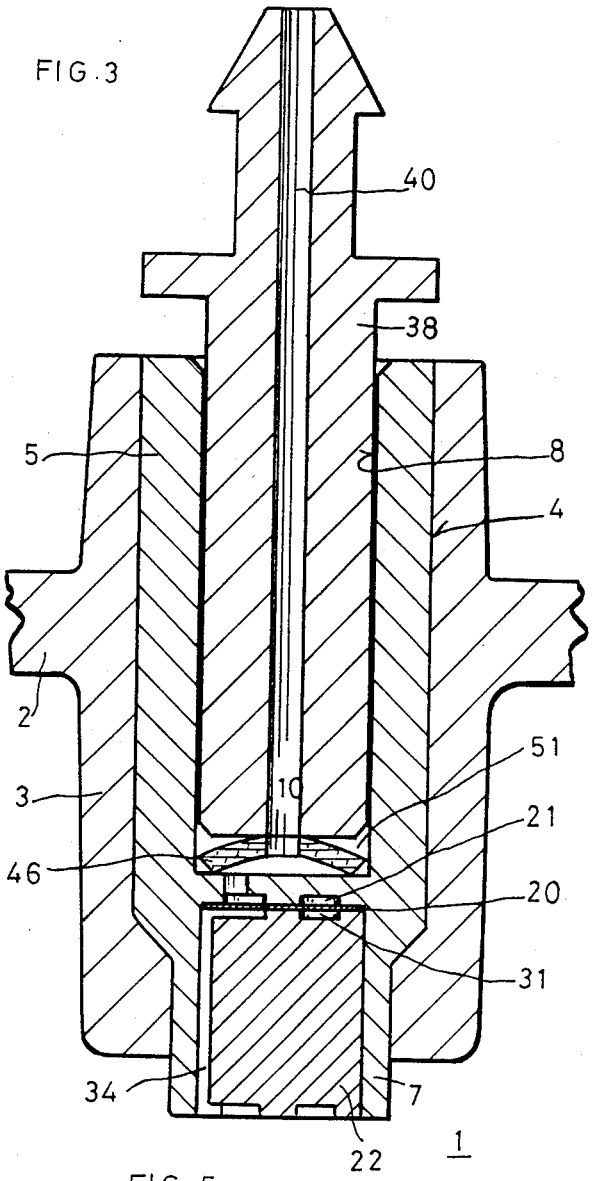
FIG. 3 is a section similar to that shown in FIG. 1 and corresponding to the open position of the valve.
Figure 4:
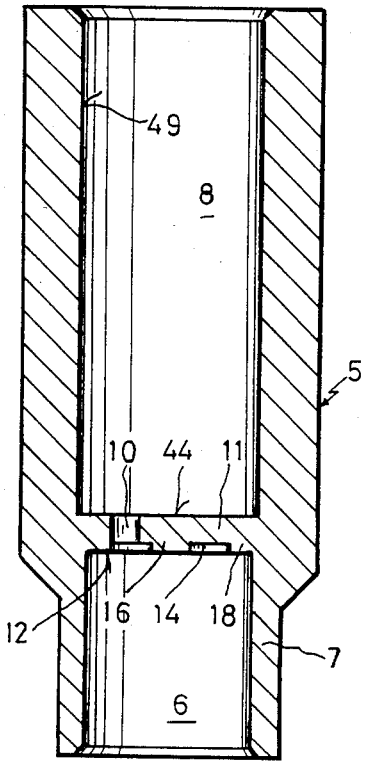
FIG. 4 is an axial section of the support member integral with the second retaining means in the form of a female element.
Figure 5:
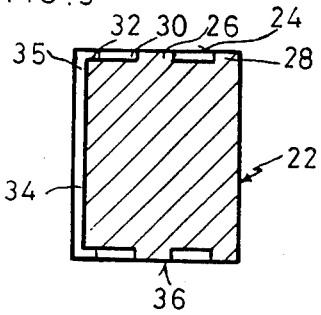
FIG. 5 is an axial section of the first retaining means in the form of a male element.
Figure 6:
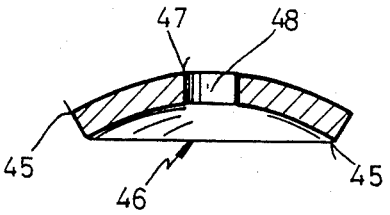
FIG. 6 is an axial section of the seal on a larger scale.
Figure 8:
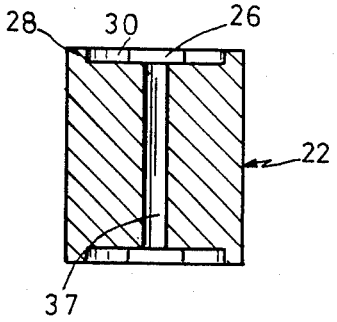
FIG. 8 is a section on the line VIII—VIII in FIG. 7.
Figure 7:
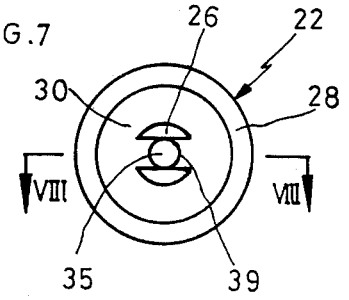
FIG. 7 is a plan view of an alternative form of construction of the male element.
Figure 14:
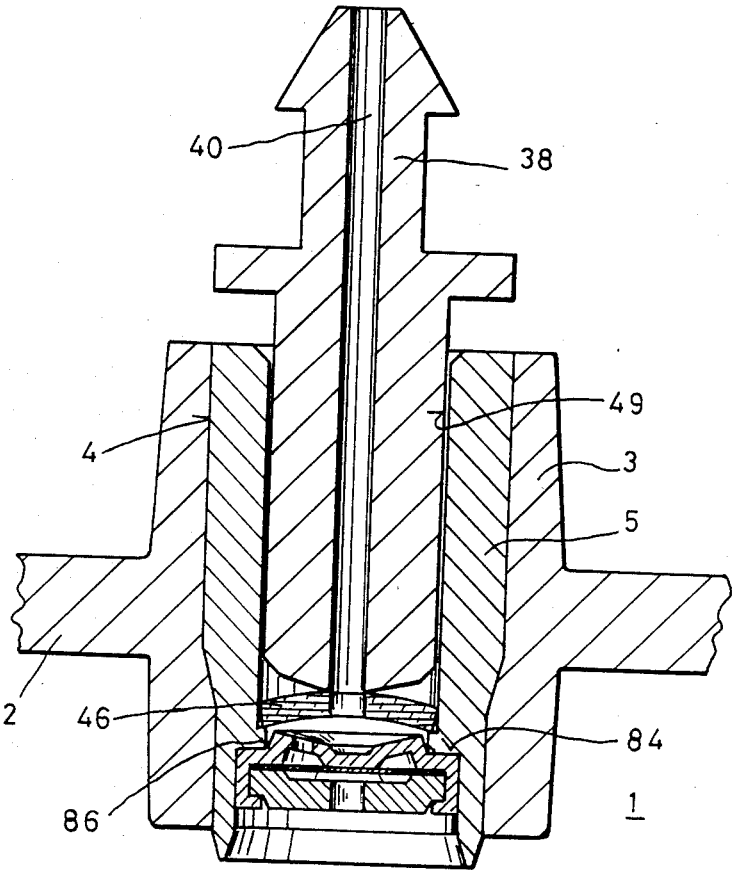
FIG. 14 is an axial section similar to that shown in FIG. 3, with the retaining means shown in FIGS. 9 to 11.

FIGS. 1, 3 and 14 show an axial section of the entire valve of the liquefied gas igniter, although some details not necessary for the understanding of the invention have been omitted.

The igniter is provided with a liquefied gas reservoir 1 bounded by a wall 2, which in the drawings is shown only in respect of its parts contiguous to the valve. In FIGS. 1, 3 and 14 it should be understood that this reservoir extends downwards from the wall 2 and that the reservoir is closed.

To hold the valve the tube 3 is provided, one part of it being inserted into the reservoir 1 while another part may project from the wall 2. This tube is preferably cylindrical and has a longitudinal through aperture 4, optionally comprising portions of different diameters. When the valve is opened fuel gas circulates from the reservoir 1, and the expressions "upstream" and "downstream" used below will indicate the directions towards and away from the reservoir respectively.

A support member 5 fits closely and sealingly into the aperture 4, the elements of the valve being housed in the interior of this member. Said support member will be described below, although provision is made for it to be constituted by the tube 3 itself, which in that case would be given the configuration of the support member.

In the embodiments shown in FIGS. 1 to 8, the support member 5, in its portion directed towards the reservoir, is in one piece with the second retaining means (in the form of a female element 7 provided with a cavity 6), while in its portion directed outwards it is provided with a socket 8. The cavity and the socket are preferably cylindrical and are in communication via a preferably eccentric aperture 10 formed in a partition 11. Nevertheless, the invention also provides for the second retaining means 7 and the socket 8 to be formed in separate parts suitably coupled together.

The face 12 constituting the end wall of the cavity has a second annular passage 14, preferably in the form of a circular crown, which delimits a central projection 16. The face 12 also has on its edge a peripheral projection 18 of the same height as the annular projection. The eccentric aperture 10 preferably has its mouth contained in the passage 14.

On the end face of the cavity 6 is disposed a microporous membrane 20 whose porosity is selected so as to obtain a flow of gas corresponding to a predetermined height of flame, which it is estimated should be between 15 and 35 millimeters. The membrane and the annular passage 14 delimit between them a second communication chamber 21.

This microporous membrane 20 is composed of a polymer having adequate stability against hydrocarbons. A certain number of microporous membranes are available on the market which comply with this condition and provide throughflow values which make them suitable for the use proposed. The very low, regular porosity which is desired is obtained either by a process of rolling under transverse tension, which gives rise to the rupture of a certain number of the weak bonds between the crystallization nuclei of the polymer, thus producing regularly distributed pores of a defined size, or else by chemical attack at predefined points by a process of nuclear irradiation which, while attacking the polymer in the bombarded zones does not affect it in adjacent zones. These two methods ensure mean porosity levels and porosity distributions which make this type of membrane suitable for the proposed use. In the membrane a peripheral zone, a central zone and an intermediate zone between these two zones should be distinguished.

A first retaining means formed by a male element 22 is housed with a good fit in the cavity 6 of the female member 7 for the purpose of fastening the membrane 20. This male element is preferably cylindrical, with a diameter very close to that of the cavity. On its base 24 facing the membrane 20 are provided a central projection 26 and a peripheral projection 28, preferably of the same height, which define between them a first annular channel 30 having substantially the shape of a circular crown; this first annular channel is substantially symmetrical to said second annular channel 14 situated in the end face 12 of the female member 7. The membrane 20 and the first circular channel 30 delimt between them a first communication chamber 31.

This male member 22 and the female member 7 (more specifically by its face 12) effect conjointly the hermetic fastening of the peripheral zone and the central zone of the membrane, leaving free the central zone of the latter.

The peripheral projection 28 is interrupted by a path 32 bringing the first chamber 31 into communication with a communication passage 34 which is narrow, that is to say its section is preferably between 0.025 and 0.09 square millimeters. The passage 34 is preferably delimited by a peripheral groove in the male member 22 and by the female member 7. On the membrane side, that is to say the downstream side, the passage 34 ends in a mouth 35 which faces a portion of the peripheral or central zone of the membrane 20, that is to say it faces a portion of membrane which is supported by the face 12 of the support member 5. There may optionally be more than one communication passage 34, complying with the condition of being very narrow and having the downstream mouth facing a portion of the central or peripheral zone.

In an alternative embodiment (FIGS. 7 and 8) provision is made for the male member 22 to have a communication passage in the form of a substantially central axial aperture 37, whose mouth 35 is situated in the central projection 26 and therefore faces the central portion of the membrane which is in contact with the central projection 16 of the female member 7. Communication between the central aperture 37 and the first annular channel 30 takes place via a groove 39, which in the example illustrated is diametrical.

The base 36 of the member 22 is preferably identical to that facing the membrane. An additional advantage for the assembly of the ignitier is thus obtained, inasmuch as during the feeding of the parts 22 it will not be necessary to distinguish the operative base.

The dimensions of the communication chambers 14 and 30 are calculated in accordance with the permeability of the membrane, which means that when this permeability has a low value a greater width will be selected for the communication chambers. It has been possible to show that the following are suitable dimensions: the largest diameter of the communication chamber is from 1.6 to 2.4 millimeters, the smallest diameter from 0.4 to 0.8 millimeter; the diameter of the communication member from 2.6 to 3.2 millimeters; the diameter of the eccentric aperture 10 from 0.3 to 0.5 millimeter.

The socket 8 of the support member 5 contains an outlet chimney 38 which is displaceable longitudinally inside the socket between a first position of maximum penetration (FIG. 1) and a second position (FIG. 3) separated from the first position by a distance limited by the actual chimney actuating means. Since they are conventional, these actuating means for the chimney 38 are not shown. The chimney is provided with an internal axial duct 40 suitable for the passage of gas.

The bottom 44 of the socket 8 is the actual partition 11 and, as has already been indicated, it is in communication with the second chamber 21 via the aperture 10. Between this bottom 44 and the chimney 38 is disposed a seal 46 provided with a central aperture 48 which is substantially in alignment with the duct 40.

This seal 46 has outer edges 45 and inner edges 47, the latter obviously surrounding the central aperture 48. The seal is adapted to vary its configuration between two extremes: a) a first application configuration (corresponding to the first position of the chimney), in which the seal 46 is completely applied under pressure against the bottom 44 of the socket and closes the eccentric aperture 10, this configuration being flat if the face 44 of the partition is flat; b) a second, arched configuration (corresponding to said second position of the outlet chimney 38), in which the seal does not close the eccentric aperture 10, but by its outer edges 45 is applied to form a tight closure between the bottom 44 and the walls 49 of the socket 8, while by its inner edges 47 it is likewise applied to form a tight closure around the duct 40 of the chimney 38, so that in both cases the circulation of gas to the chamber 51 formed between the seal 46 and the base of the chimney 38 is prevented.

The fact that this chamber 51 is cut off from the circulation of gas makes it impossible for circulation to be established between the walls 49 of the socket and the outer walls of the outlet chimney 38.

Nevertheless, when the seal substantially changes from the first configuration, the passage of gas is possible from the reservoir 1 to the outside via the passage 34 or 37, the path 32 or groove 39, the first communication chamber 31, the flow limiting membrane 20, the second communication chamber 21, the aperture 10, the aperture 48 of the seal, and the internal axial duct 40 of the chimney 38.

The seal 46 may be either flat and have a diameter larger than the section of the socket 8, so that it tends to arch by buckling, or else it may be of arched configuration. This seal is made of Buna, Neoprene or any rubber-like elastomer which is not attacked by butane and other liquefiable gases.

It is emphasized that the invention is not restricted to the obturation system described, but that the gas flow limiting device may be combined with other obturation means.

FIGS. 9 to 14 illustrate another embodiment of the invention. Parts in this embodiment which correspond to parts in the embodiments already described will as a rule retain the same reference numerals. In this embodiment the first retaining means is a body 60 of substantially cylindrical shape, with a base 62 facing the membrane and provided with a central projection 26 and a peripheral projection 28, these projections defining between them a first annular channel 30. The central projection 26 has passing through it an axial aperture 37 communicating with the reservoir 1; communication between the first annular channel 30 and the aperture 37 is in turn established by means of the groove 39, which is one again shown in diametrical form.

The second retaining means is a cap 64 adapted to receive in its interior, with a good fit, the body 60. The cap has an end part 66 (which faces the base 62 of the body 60) and a cylindrical side part 68 which surrounds, with a good fit, the cylindrical side surface of the body 60. The side part 68 is extended by an annular centripetal fin 70, that is to say a fin directed inwards, this fin being applied against the bottom face 72 of the body. Consequently, when the membrane is disposed between the body 60 and the cap 64 it is held captive and hermetically fastened by its central zone (by means of the projection 6 and the projection 74) and by its peripheral zone (by means of the projection 28 and the projection 76). The end part 66 has internally a second annular channel 78 which, in conjuction with the membrane, delimits a second communication chamber 21 (FIG. 13), in which starts a communication duct 10 leading to the outlet chimney 38.

Figure 11:
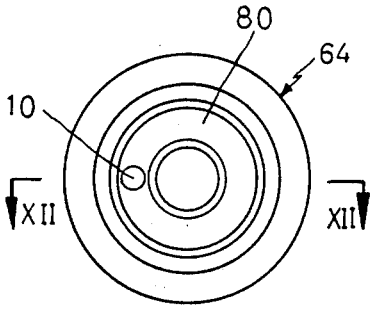
FIG. 11 is a plan view of another form of construction of the second retaining means.
Figure 9:
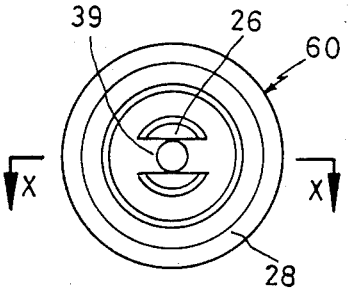
FIG. 9 is a plan view of another form of construction of the first retaining means.
Figure 12:
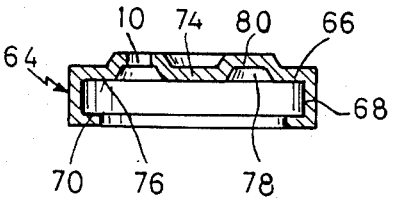
FIG. 12 is a section on the line XII—XII in FIG. 11.
Figure 10:
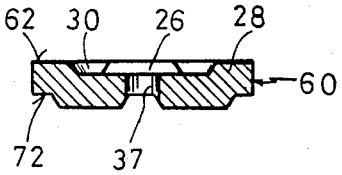
FIG. 10 is a section on the line X—X in FIG. 9.
Figure 13:
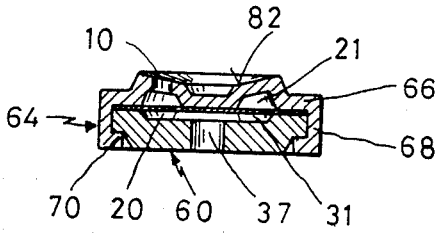
FIG. 13 is an axial section of the assembly comprising the retaining means shown in FIGS. 9 to 11.

The end part 66 of the cap 64 may have various external shapes, such as one having an annular raised portion 80 shown in FIGS. 11 and 12, or else it may have a concavity 82, which is shown in FIGS. 13 and 14 and which is substantially frustoconical in shape.

The body 60 and the cap 64 are preferably of metal, for example of brass, and, as has already been stated, they have between them the membrane 20, which they hold captive in the manner previously described.

In this compact form the retaining means 60 and 64 are fastened in the support member 5, and the end part 66 of the cap 64 is on the chimney side and correctly positioned by the annular step 84. The socket 8 of the support member 5 shown in FIG. 14 has no bottom, having instead an internal annular projection 86.

Between the cap 64 and the outlet chimney 38 is disposed a seal which, as in the previous case, is able to vary its configuration from an arched form (FIG. 14), in which the seal does not close the aperture 10 and by its outer edges 45 is applied to form a tight closure against the annular projection 86 and the inside walls of the socket, while by its inner edges 47 it is applied, likewise forming a tight closure, in the immediate proximity of the internal axial duct 40 of the chimney, to an application configuration (not illustrated) in which the seal 46 is applied against the end part 66 of the cap and closes the eccentric aperture 10.

The igniter according to the invention offers important advantages over the prior art.

In the first place, mention should be made of the better fastening of the membrane, which is hermetically fastened by its periphery and by its centre, so that a clear passage is offered to the gas by its intermediate zone. This has the result that the distance between support points on the membrane is shorter (of the order of 4 times compared with present designs). In this way accumulations of gas which has just passed through the membrane cannot occur between the latter and its downstream support member through the action of the pressure originating from the tank. Consequently no support layer is required for the membrane, either for the purpose of facilitating the circulation of fuel in the radial direction or for stiffening it, while in addition precision requirements for the devices supportng the membrane in this intermediate zone and permitting circulation are not as critical as in some known arrangements.

In the event of the igniter being subjected to an abnormal force, for example if it should fall from a certain height, there may be a sudden displacement of the liquefied gas from the reservoir to the membrane. The membrane may then be subjected to a heavy impact (hammering) which may give rise to its fracture. However, this disadvantage cannot occur with the igniter according to the invention, for the reasons which will be explained below.

On the one hand, the fact that the communication passage 34, 37 is narrow already gives rise in itself to a substantial loss of head. But in addition, since the mouth 35 of this passage 34, 37 faces a portion of the membrane 20 which is firmly supported by the support member 5, the fracture of the membrane in that portion cannot occur, and the pressure shock wave is thus distributed over the entire annular surface of the first communication chamber 31, and consequently over a much larger area than that corresponding to the area of the passage 34, 37 from which it emanates, so that considerable force is already lost. Mention must also be made of the right angle deflection which the liquefied gas must undergo through the path 32 or groove 39.

On the other hand, through the provision, downstream of the membrane, of a chamber 21 permitting its elastic deformation in the downstream direction the pressure shock wave will be absorbed by elastic deformation of the membrane, without any damage to the latter, particularly having regard to the fact that the annular area of deformation is about five times as large as in the case of a membrane having its free portion facing an aperture of the dimensions which are normal in known arrangements in the prior art.

Consequently, the elastic deformation of the membrane has already absorbed the pressure wave at the moment when said membrane is applied against the eccentric aperture 10, and therefore there is no risk of fracture at this point either.

In view of the very small volume of the communication chamber 30, the volume of liquefied gas which it could contain is also very small. Consequently, from the moment when the valve is opened, the igniter will be working almost immediately in the gas phase, while any period during which the igniter works in the liquid phase will be of very limited duration and the variation of the flame will be scarcely perceptible.

In connection with the above remarks, working in the gas phase means that when the fuel comes into contact with the membrane (in the igniter according to the invention this means when it reaches the first communication chamber 31) this fuel will be in the gaseous state. On the other hand, "liquid phase" means that the fuel in contact with the membrane is in the liquid state.

The fact that the igniter works in the gas phase also provides other advantages: greater thermal stability is achieved because the vaporization of the liquefied gas does not occur in the immediate proximity of the membrane and therefore the latter is not cooled, since it does not have to supply the vaporization heat; in addition, the membrane undergoes less contamination with any impurities which may be contained in the liquefied gas, and which obviously are not vaporized and consequently would not clog the pores of the membrane.

With regard to the obturation system, the advantages mentioned below should be noted.

Whenever the igniter is opened, the seal 46 is not moved out of contact either with the chimney 38 or with the side walls of the socket 8, and no other circulation of gas to the outside is possible than that through the central aperture 40 of the outlet chimney 38.

For the same reason, when the igniter is extinguished and consequently the chimney 38 is pressed against the bottom of the socket 8 of the support member holding the seal 46 captive, no residues of gas remain in the interstices existing between the chimney and the support member, so that the igniter is prevented from maintaining the flame during a certain period of time, as is frequently the case with other types of igniter.

For the two reasons set forth above, the play existing between the chimney and the socket of the support member is of no importance, so that it is possible to increase the tolerances in respect of the outside and inside diameters of the respective parts and to employ less expensive processes and materials, for example plastics materials, even for the chimney, in which case the top end of the latter, that is to say the burner, could be a metal part fitted under pressure over the main part of the chimney.

Finally, the above arrangement enables the chimney to be a definite body of revolution having a single central aperture, that is to say without requiring lateral apertures for feeding the central aperture or, in some cases, grooves, as is the case with the majority of igniters.

Moreover, the seal is easily fitted and is a part independent of the outlet chimney. The configuration which provides the path for the gas is responsible for the absence of turbulence in the passage from the membrane to the outlet chimney.

What I claim is:

1. Liquefied gas igniter provided with a reservoir and an outlet chimney, between which a flow of gas can be established through a gas flow passage; a support member for said outlet chimney; a device for obturating the gas flow passage; a non-regulable gas flow limiter comprising a microporous membrane having a peripheral zone, a central zone and an intermediate zone between said peripheral and central zones, said membrane not permitting the flow of gas in the radial direction in its interior; and a first and a second retaining means between which said peripheral zone of the membrane is held captive and hermetically fastened, characterized in that said first retaining means and said second retaining means hold captive and also hermetically fasten said central zone of the membrane, and in that said first retaining means has at least one passage communicating between the reservoir and the membrane, each passage being narrow and having, on the membrane side, a mouth facing a portion of the peripheral or central zone of the membrane which is in contact with said second retaining means.

2. Igniter according to claim 1, characterized in that said first retaining means is a male element of substantially cylindrical shape, with a base facing the membrane and having a central projection and a peripheral projection which between them form a first annular passage of slight depth which in turn, in conjunction with the membrane, delimits a first communication chamber, while said second retaining means is a female element which has a cavity and face forming the bottom of the cavity, the latter being adapted to receive said male element with a good fit, while said face has a central projection and a peripheral projection, which between them define a second annular passage which, together with the membrane, delimits a second communication chamber substantially symmetrical to said first chamber, a passage for communication with the outlet chimney starting in said second chamber.

3. Igniter according to claim 2, characterized in that said peripheral projection is interrupted by a communication path between said first chamber and said communication passage, which is delimited by a peripheral groove in said male element and by said female element.

4. Igniter according to claim 2, characterized in that said central projection has a groove which brings said first chamber into communication with said communication passage, which is composed of a substantially central axial aperture.

5. Igniter according to claim 1, characterized in that said first retaining means is a body of substantially cylindrical shape, with a base facing the membrane and having a central projection and a peripheral projection which define between them a first annular channel of slight depth, which in turn delimits in conjunction with the membrane a first communication chamber, said central projection having a groove which brings said first chamber into communication with said communication passage, which is constituted by a substantially central axial aperture, while said second retaining means is a cap which has an end part facing said base of said body holding the membrane captive, a cylindrical lateral part and means for fastening said body, said cap receiving said body in its interior with a good fit, and said end part having internally a second annular passage which together with the membrane delimits a second communication chamber in which starts a communication duct leading to the outlet chimney.

6. Igniter according to claim 5, characterized in that said means for fastening the body consist of an annular centripetal fin extending from said cylindrical lateral part.

7. Igniter according to claim 5, characterized in that said cap containing said body and said membrane is fixed in said support member for the outlet chimney and the end part of said cap is on the chimney side.

8. Igniter according to claim 7, characterized in that said end part of said cap has externally a concavity of substantially frustoconical shape.

9. Igniter according to claim 7, characterized in that said end part of said cap has externally an annular raised portion.

10. Igniter according to claim 2, characterized in that said female element is in one piece with said support member which is provided, opposite said cavity in the female element, with a socket for said outlet chimney, which is displaceable longitudinally in the interior of said socket between a first position of maximum penetration and a second position separated by a limited distance from said first position, and which is provided with an internal axial duct, said socket having side walls and an end wall which is in communication with the end wall of the cavity by means of an eccentric aperture, while between the end wall of the socket and the outlet chimney a seal is disposed which has outer edges and inner edges, the latter defining a central aperture substantially in line with said internal axial duct, said seal being adapted to vary its configuration between a first application configuration corresponding to said first position of the outlet chimney, in which position the seal is applied against the end wall of the socket and closes said eccentric aperture, and a second, arched position which corresponds to said second position of the chimney and in which the seal does not close said eccentric aperture and by its outer edges is applied to form a tight closure against the end wall and the side walls of the socket, while by its inner edges it is applied to make a tight closure in the proximity of the internal axial duct of the outlet chimney.

11. Igniter according to claim 7, characterized in that said support member is provided with a socket for said outlet chimney, which is displaceable longitudinally in the interior of said socket between a first position of maximum penetration and a second position separated by a limited distance from said first position, and is provided with an internal axial duct, said socket having side walls and an internal annular projection, while between the end portion of said cap and the outlet chimney a seal is disposed which has outer edges and inner edges, the latter defining a central aperture substantially in line with said internal axial duct, the seal being adapted to vary its configuration between a first application configuration corresponding to said first position of the outlet chimney, in which position the seal is applied against the end portion of said cap to close said eccentric aperture, and a second arched configuration which corresponds to said second position of the chimney and in which the seal does not close said eccentric aperture, while by its outer edges it is applied to form a tight closure against the inner annular projection and against the walls of the socket, and by its inner edges is applied to form a tight closure in the proximity of the internal axial duct of the outlet chimney.

* * * * *